United States Patent [19]

Stephens

[11] 4,206,868

[45] Jun. 10, 1980

[54] BOX TRAY

[76] Inventor: George B. D. Stephens, 1250 27th St., Newport News, Va. 23607

[21] Appl. No.: 12,057

[22] Filed: Feb. 13, 1979

[51] Int. Cl.[2] ..... B65D 5/18

[52] U.S. Cl. ..... 229/33

[58] Field of Search ..... 190/11; 206/44 R; 229/30, 33, 35; 248/174; 108/14

[56] References Cited

U.S. PATENT DOCUMENTS

| | | | |
|---|---|---|---|
| 3,088,651 | 5/1963 | Rasmusson | 229/35 |
| 3,105,626 | 10/1963 | McCormick et al. | 229/35 X |
| 3,912,155 | 10/1975 | Zastrow | 229/33 |
| 4,136,816 | 1/1979 | Gardner | 229/33 |
| 4,144,996 | 3/1979 | Kuckenbecker | 229/33 |

*Primary Examiner*—Davis T. Moorhead

*Attorney, Agent, or Firm*—Royce E. Jones

[57] ABSTRACT

This invention relates to a blank for a box structure which folds into a box or into a box with a tray structure attached. The flaps of the box blank are so structured that upon the proper fitting together, a table or tray, with supporting members to hold the tray firmly in a horizontal open position, will be formed.

2 Claims, 5 Drawing Figures

BOX TRAY

This invention relates to a one-piece blank for a box structure which folds into a closed box or into an open box having a level table or tray structure with supporting members for holding said tray structure level. It is therefore an object of the invention to provide a unique blank for a box structure.

It is another object of the invention to provide a unique blank for a box structure which is easily folded to provide the table or tray structure of the invention.

Yet another object of the invention is to provide a sturdy tray or table structure as a part of the box structure which can be re-folded and closed inside of the box structure.

These and other objects of the invention will be apparent from an examination of the following description and drawings.

The Drawings

THE DESCRIPTION

Figure 1:
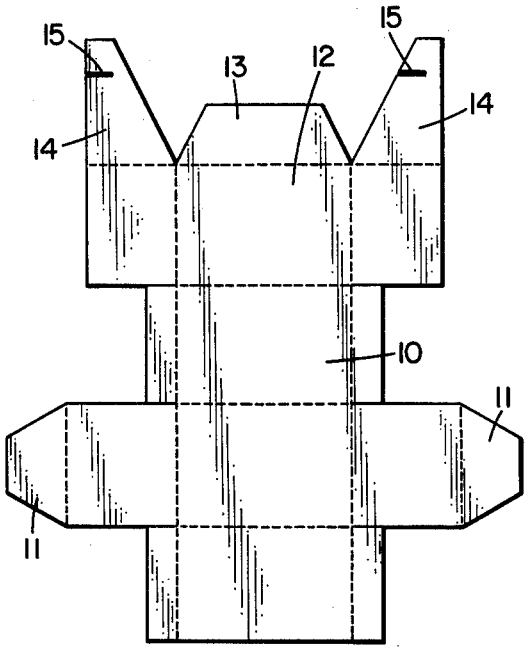
FIG. 1 is a plan view of the blank of a foldable material from which the box structure, illustrated in the other views, will be formed.

Referring to the drawings for a better understanding of the invention, it will be seen that a blank for a foldable box structure is illustrated in FIG. 1. The blank 10 is made of a material normally used for boxes of the type used by fast-food stores. Blank 10 may be folded into any of the structure of FIG. 2 through FIG. 5. The novel parts of the blank 10 are the end flaps 11, lid 12, lid flaps 13, lid extensions 14, and slots, 15. The major portion of blank 10 provides a standard box structure having a bottom section, two end walls, two side walls, and a lid, with regular flaps and joining structures.

Figure 2:
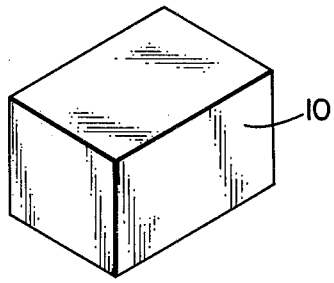
FIG. 2 is a perspective view of the closed box of the invention as shown with the lid and all flaps closed inside.

In FIG. 2 flaps 11, flaps 13, and lid extensions 14 are closed within the basic box structure. In this position the food products, for which the box is being used, may easily be transported.

Figure 3:
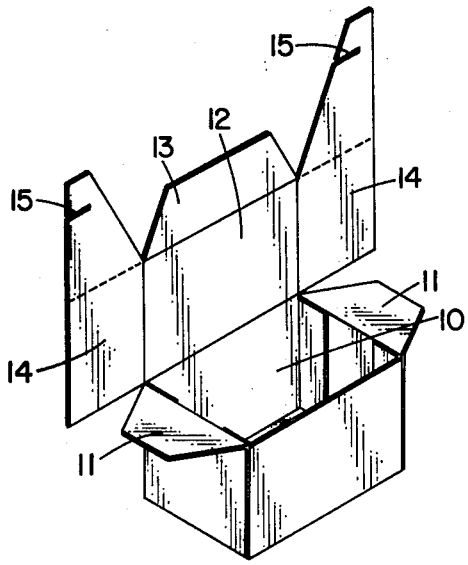
FIG. 3 illustrates the box structure of the invention with flaps spread to the open position prior to the folding of the lid extensions to the closed box position or to the position of support of the box lid as a tray or table member.

The open box structure of FIG. 3 illustrates the component parts of the invention. Food products may be removed from the box when the box is in this form. The lid 12, with connected flap 13, lid extensions 14 and slots 15, is now ready to have the lid extensions 14 connected together, on the outside of lid 12, by inserting one slot 15 within the other slot 15. By locking the slots together a table or tray will be formed with lid 12 as the top of the table or tray and with lid extensions 14 providing a sturdy and durable support for the box tray.

Figure 4:
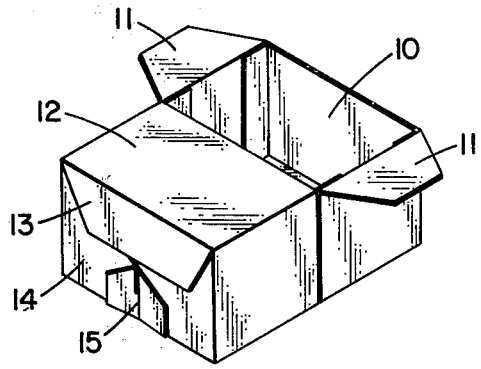
FIG. 4 is a view of the box structure with the lid extensions folded into position to support the lid as table or tray structure ready for use.
Figure 5:
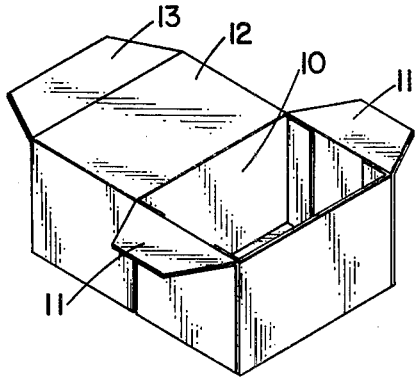
FIG. 5 is a different view of the box structure assembly for use with the tray in position.

FIG. 4 and FIG. 5 illustrate the assembled box tray of this invention. Blank 10 has been folded into the box of FIGS. 2 and 3 and then has the lid extensions 14 locked together to form the tray into its useful position. In FIG. 4 the lid 12 is ready for use, having lid extensions 14 locked together via slots 15. Food from the box may be placed upon lid 12, which is the tray, supported by the lid extensions of the invention. In FIG. 5 a different view of the completed box structure with tray in position is illustrated in position ready for use.

In the instant invention the novel features of the lid extension 14 with slots 15 provide a quick and easy means for providing a sturdy, yet reuseable, tray structure for instant use.

From the above description it will be apparent to those skilled in the art that the subject matter of this invention is capable of some variation in detail, and it is preferred, therefore, that the scope of protection be not limited to the example described herein but by the appended claims.

What is claimed is:

1. A one-piece foldable blank for forming a box structure comprising:
   - (a) the standard components of a foldable box blank including sections for the bottom, front and rear walls, end walls, a lid, and flaps on each end wall and lid;
   - (b) a lid extension connected onto each end of the lid portion of said blank;
   - (c) each lid extension being foldably engaged with the lid portion of said blank in such a manner as to be folded against the lid in order to be closed within the box when completed, or to be locked with the other lid extension to provide supporting means for the lid portion so that the lid portion may be used as a tray or table;
   - (d) the locking means for the lid extension consisting of a slot provided in each lid extension near the end thereof.

2. The invention of claim 1 further limited in that the lid extension may be unlocked after use and folded within the box so as to be reuseable.

* * * * *